US011008758B2

(12) United States Patent
Lætgaard

(10) Patent No.: US 11,008,758 B2
(45) Date of Patent: May 18, 2021

(54) METHOD FOR COVERING A GAP BETWEEN WINDOWS AT THE RIDGE OF A DOUBLE PITCH SKYLIGHT, A DOUBLE PITCH SKYLIGHT, AND A COVER ELEMENT FOR USE THEREIN

(71) Applicant: VKR Holding A/S, Hørsholm (DK)

(72) Inventor: Thomas Lætgaard, Horsens (DK)

(73) Assignee: VKR Holding A/S

( * ) Notice: Subject to any disclaimer, the term of this patent is extended or adjusted under 35 U.S.C. 154(b) by 0 days.

(21) Appl. No.: 16/589,235

(22) Filed: Oct. 1, 2019

(65) Prior Publication Data

US 2020/0115904 A1 Apr. 16, 2020

(30) Foreign Application Priority Data

Oct. 12, 2018 (DK) ..... PA 2018 70671

(51) Int. Cl.
*E04B 7/18* (2006.01)
*E04D 13/03* (2006.01)

(52) U.S. Cl.
CPC ..... *E04D 13/0335* (2013.01); *E04D 13/0305* (2013.01)

(58) Field of Classification Search
None
See application file for complete search history.

(56) References Cited

U.S. PATENT DOCUMENTS 1,579,901 A * 4/1926 Whyte ..... B61D 17/12 52/55
1,921,303 A * 8/1933 Raschka ..... E04B 7/063 52/200
1,931,750 A * 10/1933 Blaski ..... E04D 3/08 52/72
3,139,958 A * 7/1964 De Witt ..... E04B 1/3445 52/70
3,150,463 A * 9/1964 Nearing ..... E04B 1/24 52/92.2
4,057,941 A * 11/1977 Schwartz ..... E04H 15/02 52/63
4,114,330 A * 9/1978 Sukolics ..... E04D 3/08 52/200

(Continued)

FOREIGN PATENT DOCUMENTS

EP 2472028 7/2012

*Primary Examiner* — Basil S Katcheves
(74) *Attorney, Agent, or Firm* — Merek, Blackmon & Voorhees, LLC

(57) ABSTRACT

The invention relates to covering a gap between windows at the ridge of a double pitch skylight including at least one pair of windows. Each window comprises a frame with a frame top member and the windows of a pair are interconnected by one or more mounting brackets at the ridge. A cover element is arranged so that it interconnects the two windows of the pair on the interior side and extends in parallel with the ridge length direction. One edge of the cover element is inserted in a groove in the top frame member of one window of the pair and another opposite edge is inserted in a corresponding groove in the other window. The cover element is preferably made from an airtight material, is preferably convex on the interior side in the mounted state, and is preferably provided with elastic connecting parts at the two opposite edges.

20 Claims, 11 Drawing Sheets

(56) References Cited

U.S. PATENT DOCUMENTS

| | | | | |
|---|---|---|---|---|
| 4,251,964 | A * | 2/1981 | Francis | E04D 3/08 52/204.593 |
| 6,000,176 | A * | 12/1999 | Lancaster | E04B 7/063 52/198 |
| 6,223,481 | B1 * | 5/2001 | Rickman | E04D 3/08 52/460 |
| 6,298,619 | B1 * | 10/2001 | Davie | E04B 1/14 52/220.7 |
| 6,389,770 | B1 * | 5/2002 | Santavicca | E04B 1/0046 52/13 |
| 7,017,307 | B2 * | 3/2006 | Jones | E04B 7/063 52/200 |
| 7,814,727 | B2 * | 10/2010 | LaCasse | E04B 1/0046 52/764 |
| 7,836,641 | B2 * | 11/2010 | Back | E04D 13/1478 52/90.1 |
| 9,777,533 | B2 * | 10/2017 | Lindgren | E06B 3/26 |
| 10,053,854 | B2 * | 8/2018 | Hildestad | E04D 12/008 |
| 2004/0163328 | A1 * | 8/2004 | Riley | E04B 7/22 52/82 |
| 2005/0166479 | A1 * | 8/2005 | Back | E04B 7/04 52/93.1 |
| 2012/0167496 | A1 * | 7/2012 | Lindgren | E04D 13/031 52/204.1 |

* cited by examiner 2
23
23
22
22
XII
23
2
25
25
28
3
4
2

2
4
20
3
II
2
4
2
4
2
4

METHOD FOR COVERING A GAP BETWEEN WINDOWS AT THE RIDGE OF A DOUBLE PITCH SKYLIGHT, A DOUBLE PITCH SKYLIGHT, AND A COVER ELEMENT FOR USE THEREIN

TECHNICAL FIELD

The present invention relates to a method for covering a gap between windows at the ridge of a double pitch skylight including at least one pair of windows, where each window comprises a frame with a frame top member, an exterior side facing the exterior of a building, an interior side facing the interior of the building, and a set of mounting brackets, said windows of said pair being mounted with their frame top members extending in parallel with each other and in parallel with a ridge length direction, and said windows of said pair being inclined in opposite directions so that an interior ridge angle between their interior sides is less than 180 degrees, said windows of said pair being interconnected by one or more mounting brackets at the top frame member of one window being connected to one or more corresponding mounting brackets at the top frame member of the other window, and where a cover element is arranged so that it extends in parallel with the ridge length direction and between the top frame members of the windows of the pair on the interior side. The invention also relates to a double pitch skylight and to a cover element for use in such a method or skylight.

BACKGROUND ART

A double pitch skylight and method for forming the same is known from EP2472028B1, where the cover element includes a cover profile made of e.g. aluminium to which a strip of an insulating material is adhered and where the cover element is kept in place by being connected to clamping discs on the exterior side by means of bolts. The resilience of the insulating material allows the use of this cover element for a relatively broad range of interior ridge angles, but the connection is not always sufficiently vapour tight to meet the strictest construction standards.

SUMMARY OF INVENTION

It is therefore the object of the invention to provide a method, a double pitch skylight, and a cover element for use therein which allows the formation of a tighter connection between the cover element and the windows. Specifically, it is desired to provide a method, a double pitch skylight, and a cover element which can be used in swimming pool buildings with a reduced risk of high humidity air containing chlorine ions reaching mounting brackets used at the top frame members of the windows.

In a first aspect of the invention this is achieved with a method where one edge of the cover element is inserted in a groove in the top frame member of one window of the pair and where another opposite edge of the cover element is inserted in a groove in the top frame member of the other window of the pair so that the cover element interconnects the two windows of the pair.

In a second aspect of the invention the object is achieved with a double pitch skylight where each top frame member comprises a groove extending in parallel with the ridge length direction at the interior side of the window, and where the cover element is arranged with one edge inserted in the groove in the top frame member of one window of the pair and another opposite edge inserted in the groove in the top frame member of the other window of the pair so that the cover element interconnects the two windows of the pair.

By inserting the edges of the cover element into grooves in the window frames rather than relying on it being pressed against the interior surfaces of the window frames, the risk of the connection becoming less tight over time is reduced.

The wording "a groove extending at the interior side of the window" is intended to mean that the groove is provided close to the interior side of the window. It does not necessarily mean that it has to be in the interior surface of the top frame member extending substantially in parallel with the interior side of the window. On the contrary, it is presently preferred that the groove used is one of the grooves already provided in the outer side of the top frame member of many windows, i.e. the side extending between the interior side and the exterior side and facing away from the opening defined by the frame members. Such grooves are typically adapted for the attachment of gaskets or mounting brackets and/or for housing cables or other electrical components. It is, however, also possible to provide the frame top members with grooves specially adapted for receiving the cover member.

In order to bring the edges into the grooves, the cover element is preferably bent about an axis, which is parallel to the ridge length direction. The cover element is preferably made from an elastic material. The elasticity means that the cover element will return towards its original shape and thus press the edges into the grooves.

In a preferred embodiment the cover element in an un-deformed state is wider than the distance between the grooves in the top frame member of the two windows of the pair and still more preferred wider than the distance between the bottoms of the grooves so that the cover element is prevented from returning to its un-deformed state once inserted in the grooves. This will result in the edges of the cover element pressing against the inner sides of the grooves and thus keeping the cover element in tight contact with the window frames. It may also result in the cover element assuming a curved cross-sectional shape in the mounted state. In one embodiment, the cover element in the mounted state is convex on the interior side. This may not only be desired for aesthetical reasons. The inwards convex shape may also help lead any condensation forming at the interior side away from the joints between the cover element and the window frames, thus potentially contributing to avoiding deterioration of the window frames and/or any gaskets or the like used at the joints.

The inner sides of the grooves may be provided with gaskets, surface profiling or the like in order to facilitate a tight contact with the cover element.

Another way of facilitating the good contact between the edges of the cover element and the grooves in the window frames is to make the opposite edges of the cover element with elastic connecting parts, which are inserted in the grooves during or following a compression of the connecting parts. When re-expanding the connecting parts will fill out the grooves wholly or partially and come into tight contact with the inner sides of the grooves. If the connecting parts are made of rubber or a like material with a high frictional resistance, the connecting parts will be retained in the grooves by friction between them and the inner sides of the grooves. Proving the connecting parts with barbs or barb-like flanges may provide similar advantages. In one embodiment the connecting parts are gaskets attached to or formed in one with the edges of the cover element. Gaskets having a cross-sectional shape with a closed hollow at the centre are presently considered advantageous due to their high compressibility. The connecting parts preferably extend over the entire length of the cover element, but may also be provided locally at intervals along the length of the cover element.

It is to be understood that the connecting parts form part of the edges of the cover element.

In order to ensure a tight connection, it is presently preferred that one single cover element covers the entire length of the double pitch skylight, i.e. typically spanning over a plurality of pairs of windows arranged in continuation of each other in the ridge length direction. In one embodiment the cover element is therefore provided in a length corresponding substantially to the length of the skylight in the ridge length direction. In another the cover element is longer than the double pitch skylight and is cut to length during installation. If opting for the latter embodiment, the cover element may for example be provided in a rolled up stage, unrolled as far as is needed to cover the length of the double pitch skylight, and then cut off from the rest of the roll.

In one embodiment, which is presently preferred, the cover element itself is made from an airtight material, but tightness may also be achieved by applying a surface coating or a barrier. A barrier may for example be a sheet of plastic applied at the gap between the top frame members of the windows of the pair before applying the cover element.

It is noted that it may be advantageous to make the cover element slightly longer than the total width of the windows of the double pitch skylight in the ridge length direction so that it extends somewhat beyond the windows at the ends in the mounted state. This may facilitate an interconnection of the cover element with a vapour barrier used for example at a gable of the double pitch skylight and hence contribute to a further improved tightness of the double pitch skylight. A connection between a vapour barrier and the cover element may for example be achieved by means of tape, adhesive, or glue.

In one embodiment at least one support member is arranged on the exterior side of the cover element and connected to both windows of the pair, preferably to both top frame members. Such support members may help keep the cover element in place and may be provided at regular intervals along the double pitch skylight. In other embodiments the support member(s) is used only at the ends to support the cover element where it is connected to vapour barriers or the like. It is also possible to provide a support member on the interior side of the cover element.

In one embodiment, where a gap between windows at the ridge of a double pitch skylight including at least two pair of windows is covered, one or more side sealing gaskets are provided at the joint between two pairs of windows, said side sealing gasket(s) extending along neighbouring frame side members of the windows of the two pairs. In this embodiment, each edge or connecting part of the cover element is brought into engagement with the side sealing gasket(s), preferably resulting in a compression of the sealing gasket(s) and/or the edges or connecting parts of the cover element. By establishing a vapour tight contact between the sealing gasket(s) used along the sides of the windows and the cover element used along the tops of the windows the entire structure can be made airtight without the need for applying a joint sealant. This of course leads to a reduced number of work operations and hence potentially a quicker installation process with a reduced risk of error. An additional and very important advantage is that it will not be necessary to work on the interior side of the ridge structure. As double pitch skylights, also known as ridge lights, are usually used in buildings with a very large floor-to-ceiling height such work will usually require the use of scaffolding or a lift and is therefore relatively cost-intensive.

A third aspect of the invention relates to a cover element for use in a method according to the first aspect of the invention or a double pitch skylight according to the second aspect of the invention. As mentioned above, the cover element preferably comprises elastic connecting parts forming part of two opposite edges extending in parallel with a length direction of the cover element, said connecting parts being adapted for being inserted in grooves in window frames.

In a further embodiment of the cover element a cover part of the cover element is substantially flat in an un-deformed state and the connecting parts extend in the same direction and substantially perpendicularly to the plane defined by the flat cover part. This entails that when the connecting parts are inserted in grooves in the top frame members extending substantially in parallel with the plane of the window frame, the cover part will be forced into a bent state, which is preferably convex towards the interior as also described above.

In the description above the features of the invention and their advantages have been described with reference to all three aspects of the invention and it is to be understood that throughout this description features described with reference to one aspect of the invention also applies to the other aspects of the invention unless otherwise stated.

BRIEF DESCRIPTION OF DRAWINGS

In the following description, embodiments of the invention will be described with reference to the schematic drawings, in which.

DESCRIPTION OF EMBODIMENTS

Figure 1:
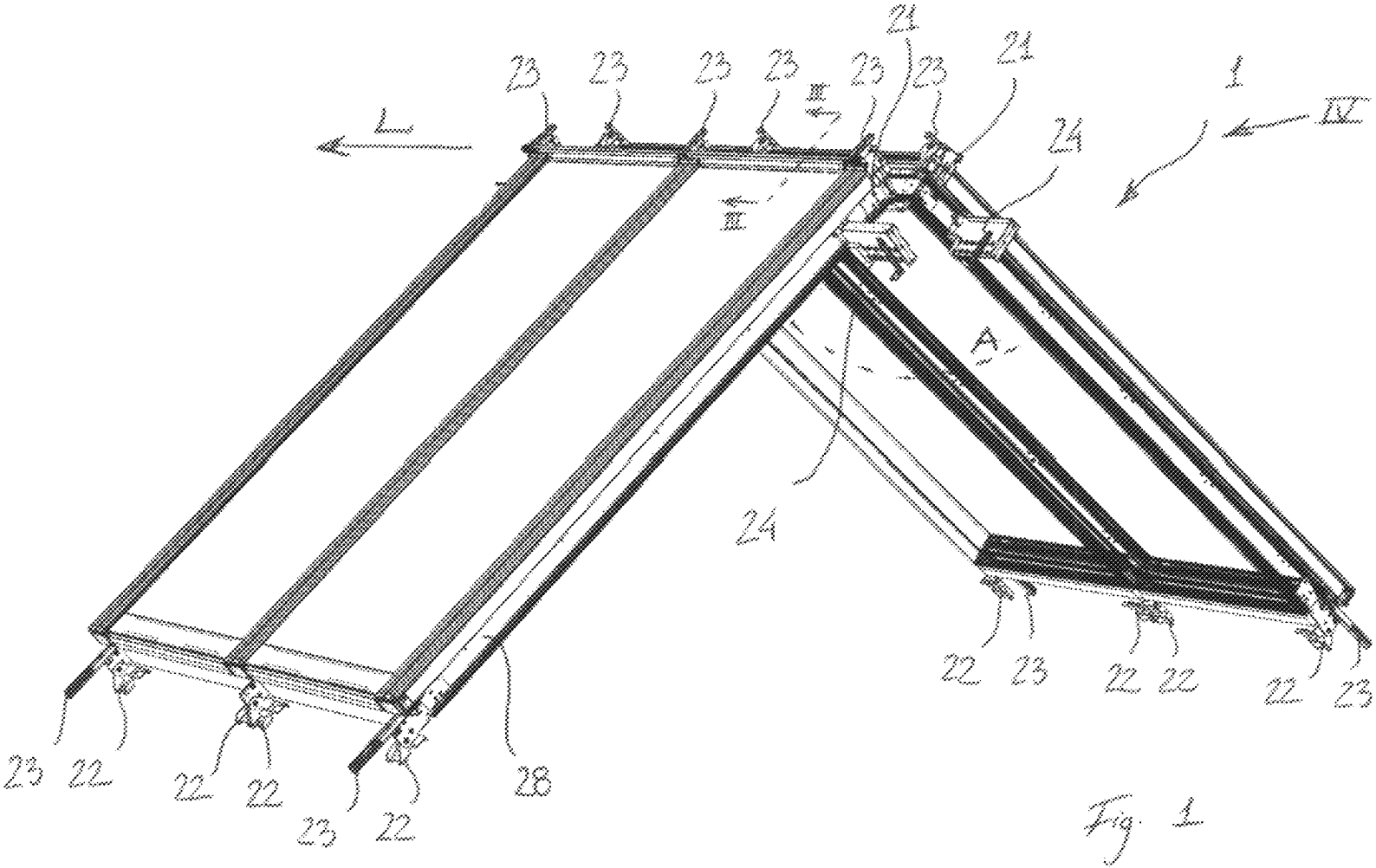
FIG. 1 is a perspective sketch of a double pitch skylight seen from an end.
Figure 2:
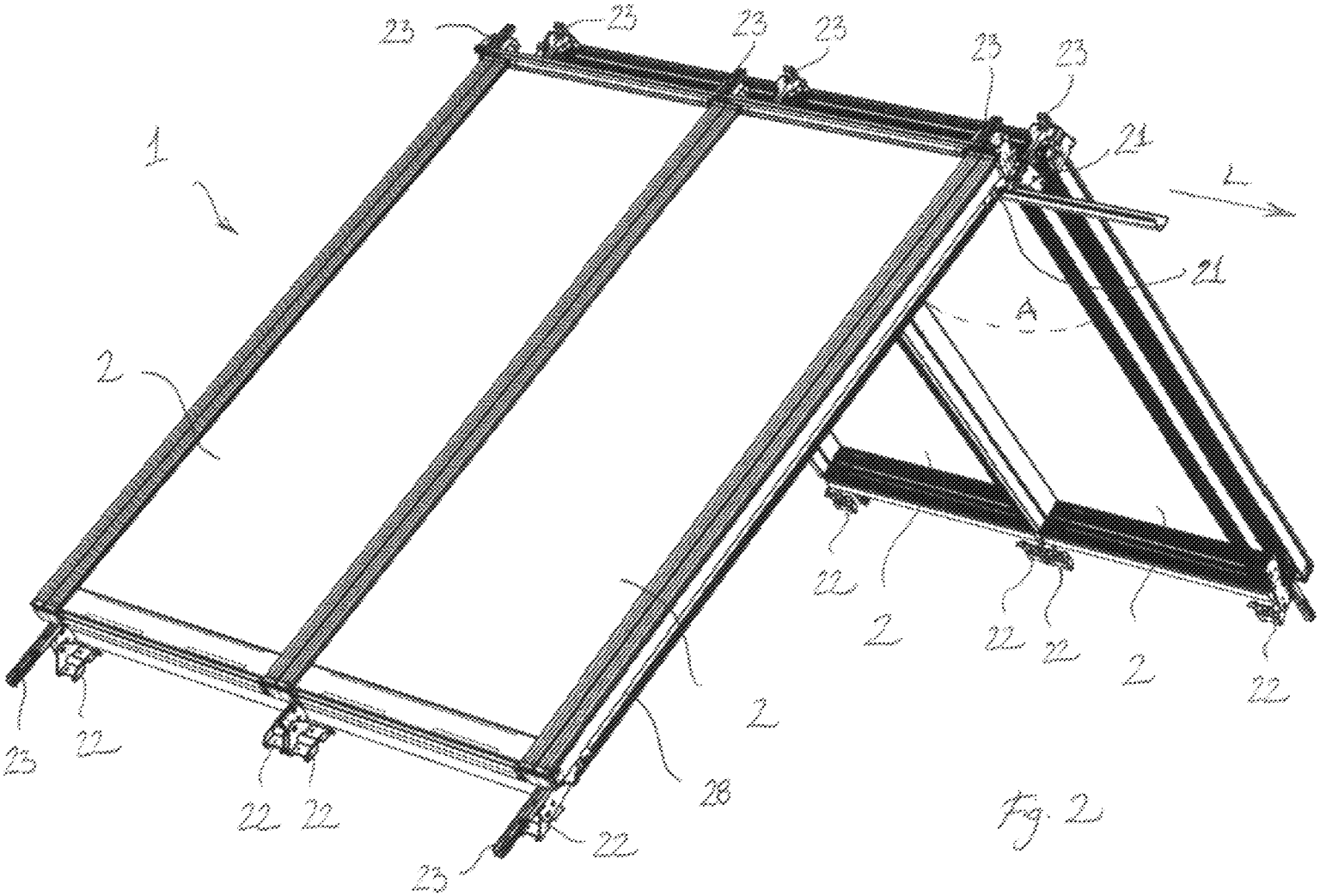
FIG. 2 is a perspective view of the double pitch skylight in FIG. 1 seen from the other end during construction.

FIGS. 1 and 2 show a double pitch skylight 1 including two pairs of windows 2 seen from opposite sides, where the windows of each pair are mounted with their frame top members extending in parallel with each other and in parallel with a ridge length direction L. The windows of each pair are inclined in opposite directions so that an interior ridge angle A between their interior sides is less than 180 degrees.

Each window is provided with first mounting brackets 21 at its top frame member interconnected to corresponding mounting brackets 21 at the top frame member of the other window of the pair so that the windows of each pair are connected at the top of the double pitch skylight. Furthermore, each window is provided with second mounting brackets 22 for connecting it to a load-bearing structure (not shown) such as an upstand on a roof. Parts of the mounting brackets 21 at the top are not shown here, but will be shown in later figures.

Furthermore, each window is provided with connector elements 23, 24 adapted for connecting flashing members (not shown) to the window frames. The connector elements 24 adapted for connecting a gable flashing (not shown) at the end of the skylight to the windows are shown only in FIG. 1.

It is noted that the windows 2, mounting brackets 21,22, and connector elements 23,24 shown in the drawing are only to be regarded as one embodiment serving as an example and that the invention is not to be regarded as limited to such windows. For example, the invention will also be advantageous in double pitch skylights where flashing members are attached without the use of connector elements.

Figure 3:
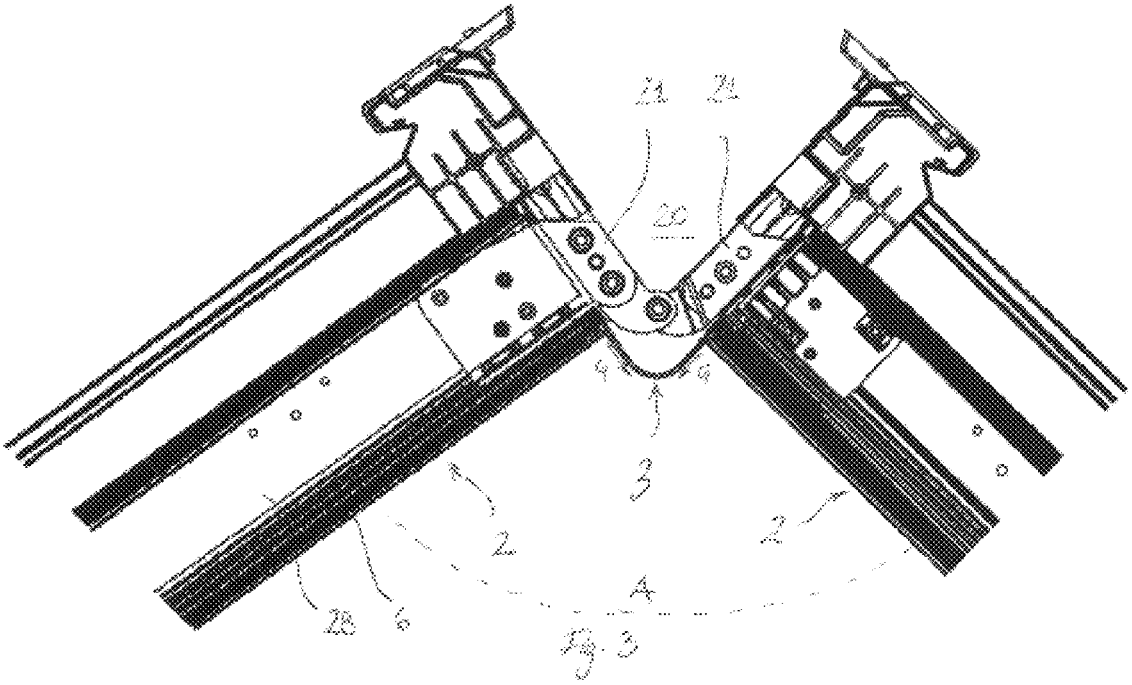
FIG. 3 is a cross-sectional view along the line III-III in FIG. 1.
Figure 4:
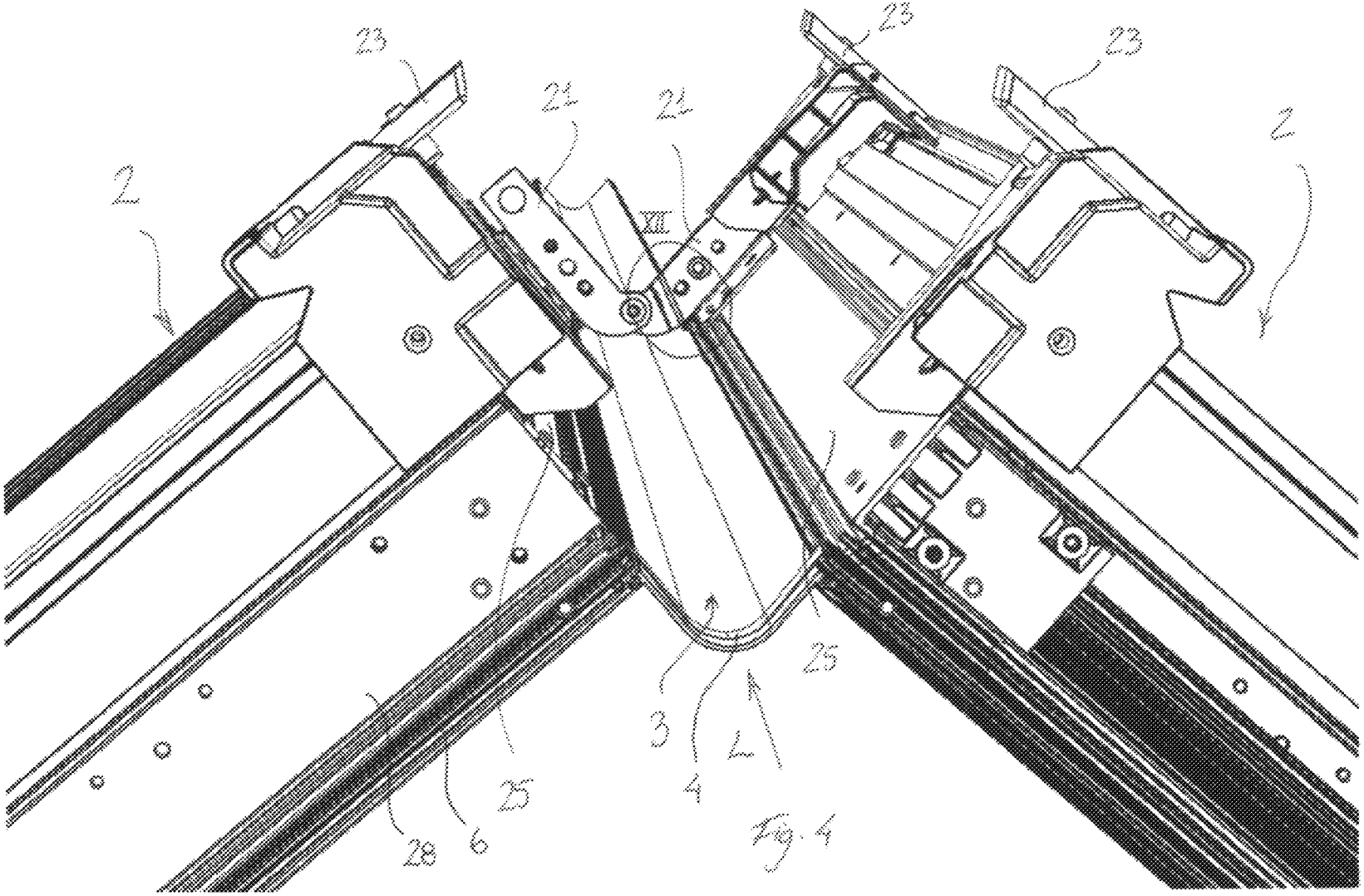
FIG. 4 shows a double pitch skylight as in FIGS. 1 and 2 from the angle indicated by the arrow IV in FIG. 1, but including only one pair of windows and only some of mounting brackets and connector elements.
Figure 5:
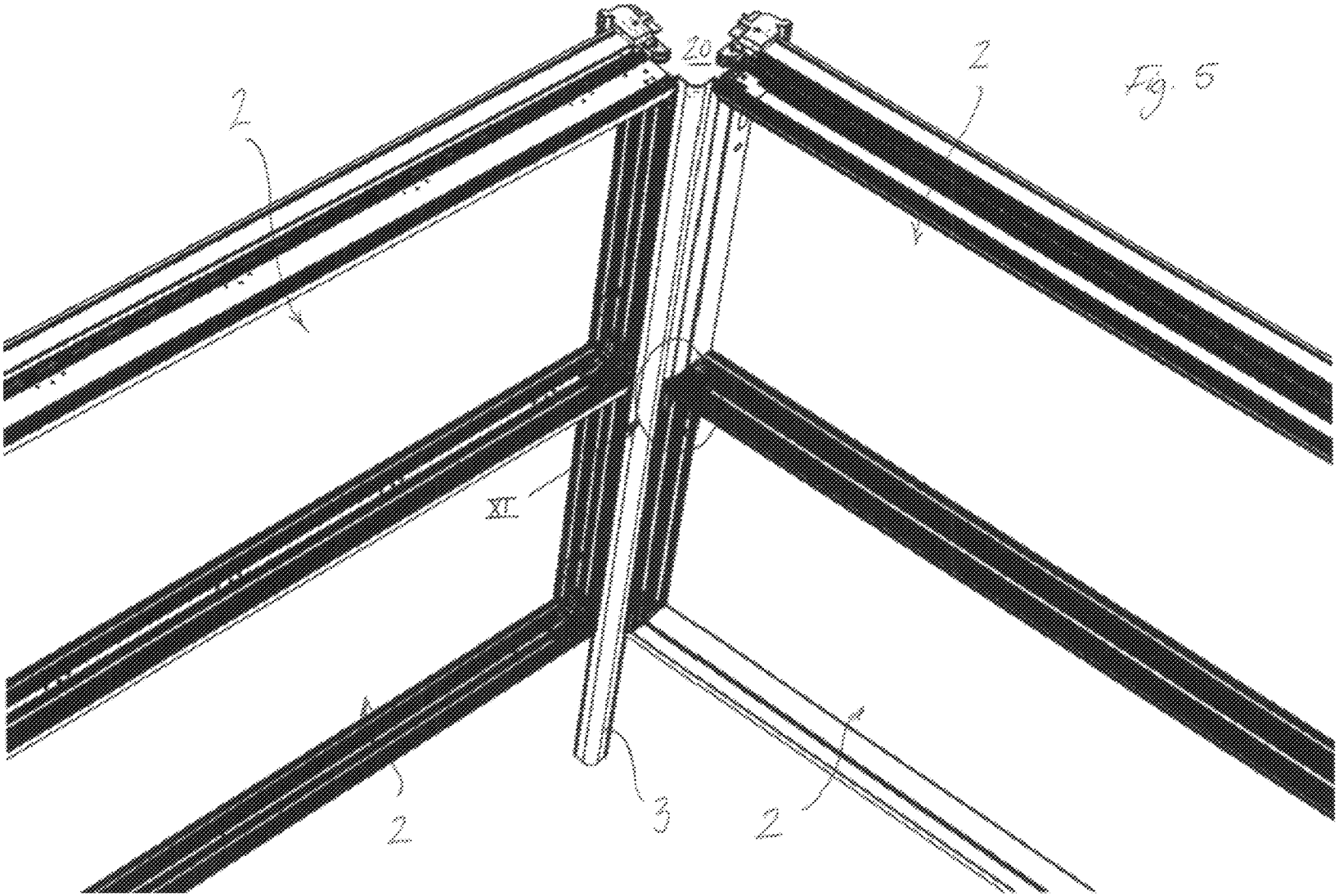
FIG. 5 shows a double pitch skylight as in FIGS. 1 and 2 from the interior side during construction, FIG. 6 corresponds to FIG. 3 but shows only two opposite frame top members and the cover element.

Referring now also to FIGS. 3-5 it is seen that the gap 20 between the frame top members 25 of the windows of each pair is closed off at the interior side by a cover element 3 spanning from one frame top member to the other. The cover element is arranged so that it extends in parallel with the ridge length direction L, spanning over both pairs of windows. In double pitch skylights including more than two pairs of windows (not shown) it is preferred that the cover element 3 spans over all of them in the ridge length direction L in over to make the construction as tight as possible.

In the embodiment shown, the cover element 3 is convex on the interior side. This entails that any condensation forming on the interior side of the cover element will tend to drain towards the centre of the cover element under the influence of gravity as indicated by the arrows G in FIG. 3, thus leading moisture away from the frame top members.

As is seen in FIG. 4 a support member 4 is arranged on the exterior side of the cover element 3 and connected to the top frame members 25 of the two opposite windows 2. The purpose of this support member is to keep the cover element in its intended position, which is particularly relevant at the ends of the cover element. It is, however, possible to have several such support members 4 distributed over the length of the cover element or to integrate them in the cover element material. It is also possible to use the cover element without additional support.

The connection between the cover element 3 and the respective top frame members 25 of the two windows of a pair is achieved by one edge of the cover element being inserted in a groove 26 in the top frame member of one window of the pair and another opposite edge of the cover element being inserted in a groove 26 in the top frame member of the other window of the pair. This is shown in cross-section in FIG. 6, where everything but the two opposite frame top members 25 and the cover element 3 have been removed for clarity.

Figure 6:
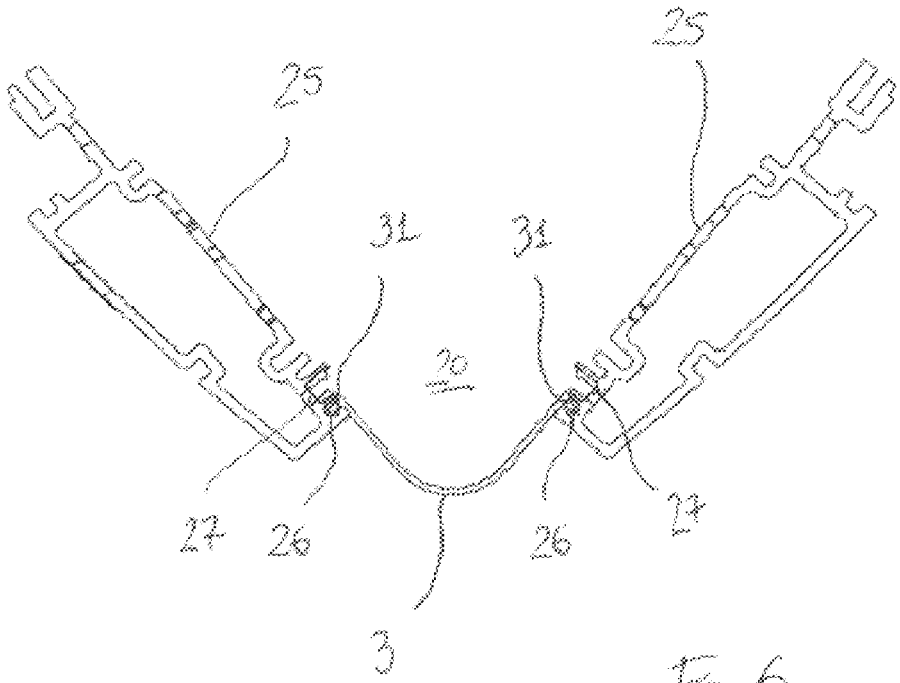
Figure 7:
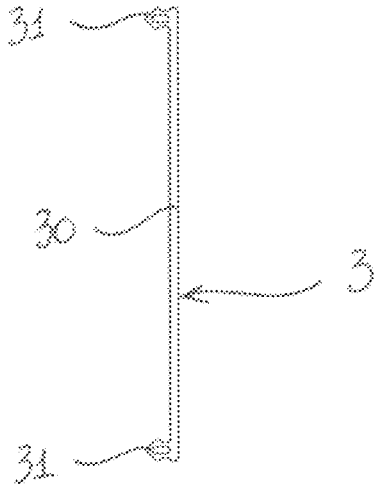
FIG. 7 shows a cover element from the end in its un-deformed state.

As mentioned above it is presently preferred to use a cover element 3 made from an elastic material which is bent about an axis, which is parallel to the ridge length direction L during installation so that the cover element in the mounted state is convex on the interior side. The cover element in FIG. 6 is shown in its un-deformed state in FIG. 7.

In this embodiment, the cover element 3 comprises a flat cover part 30 and two elastic connecting parts 31 at the opposite edges of the cover element. These connecting parts 31 are adapted for being inserted in the grooves in the frame top members 25 during or following a compression of the connecting parts.

Figure 8:
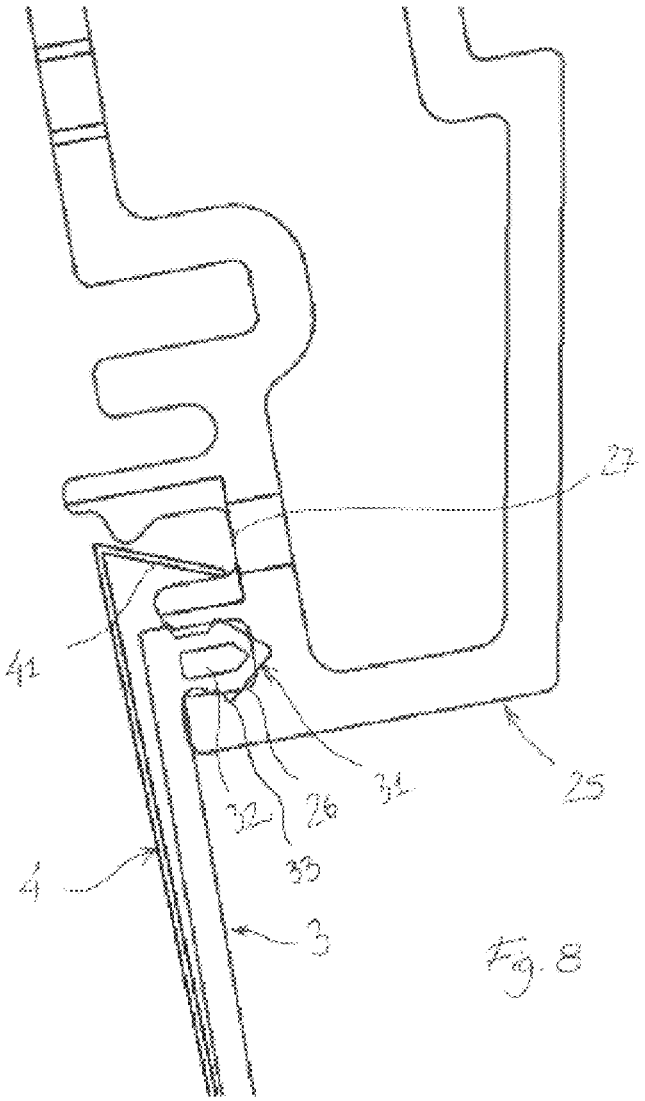
FIG. 8 is a cross-sectional view showing how the cover element and a support member is inserted in grooves in a top frame member.

In FIG. 8 a connecting part 31 is shown in its un-deformed state overlapping the groove 26 in the frame top member 25 and it is seen that the un-deformed connecting part is slightly larger than the space available in the groove. A hollow 32 in the connecting part 31 allows that connecting part 31 to be compressed and the connecting part can be retained in the groove only under the influence of the pressure from elastic material trying to get back to its original shape and the resulting friction between the connecting part 31 and the inner sides of the groove 26. The projecting ridges 33 contribute to the friction and may engage with projections (not shown) on the inner sides of the groove 26, thus serving as barbs.

It is of course possible to embody the connecting parts 31 differently and still reach the same result. For example, the hollow 32 may be replaced by one or more spaces between ribs or flanges (not shown) as is common in gaskets.

FIG. 8 also shows how an engagement part 41 of a support member 4 is inserted in a second groove 27 in the frame top member 25. The support member is typically made from a sheet material such as aluminium or stainless steel which has been bent substantially but not entirely to its intended shape during manufacture and which can be bent slightly further so that engagement parts 41 at its two opposite ends, cf. FIG. 9, can be brought into groove 27 in two opposite frame top members 25. The material used for the support member is preferably elastic so that the resilience of the material presses the engagement parts 41 into the grooves 27 in the top frame members.

Figure 9:
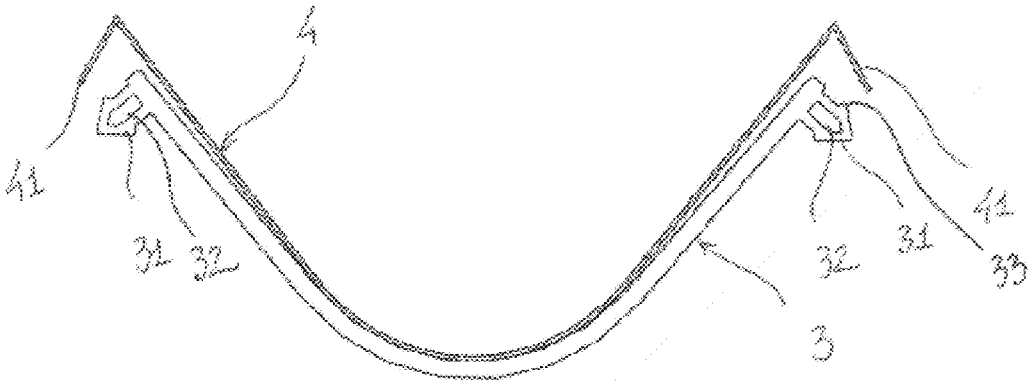
FIG. 9 shows the cover element and support member from the end in their deformed state.

The cover element 3 and the support member 4 in their mounted condition are shown in FIG. 9.

It is noted that the engagement part 41 may be embodied in many other ways than the one shown in FIGS. 8 and 9. It only needs to be able to keep the support member in place.

As appears from FIGS. 3-6 the cover element 3 provides a tight connection between the two opposite windows 2 of a pair and if using one uninterrupted cover element extending over the entire length of the double pitch skylight and made from an airtight material the ridge can be made entirely air tight. This will prevent vapour from penetrating from the interior of a building to the space 20 between top frame members 25, where the formation of condensation could potentially cause damage to the construction. This is particularly useful in buildings housing swimming pools, where the water vapour will typically contain chlorine ions which are known to cause corrosion on metal parts, such as the mounting brackets 21.

In one embodiment, the cover element 3 is provided in a rolled-up state and unrolled as it is needed. When the entire double pitch skylight 1 has been covered, the cover element is cut off the roll. It is, however, also possible to cut off the needed length of cover element before starting the installation thereof, or even to produce the cover element in the desired length.

Figure 10:
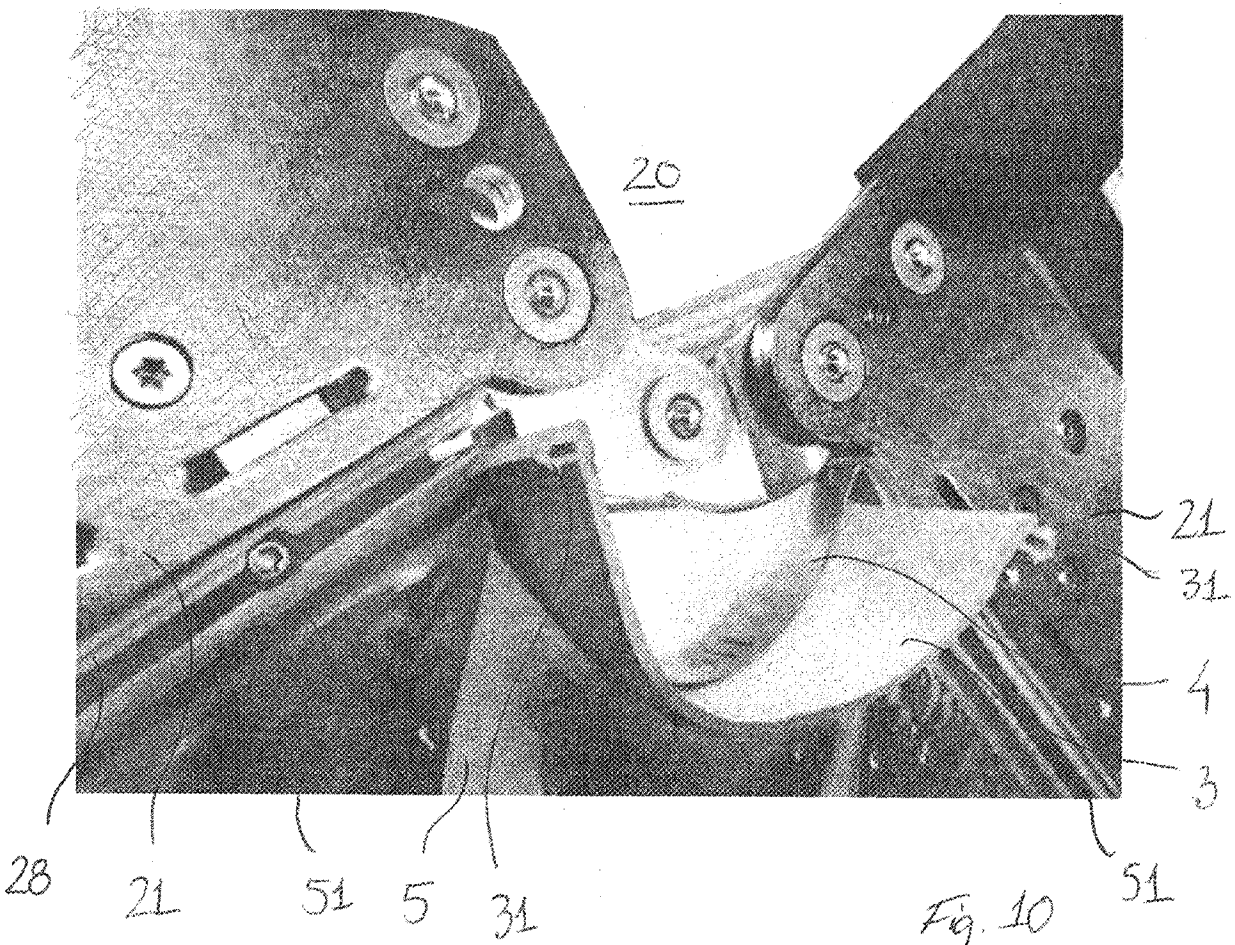
FIG. 10 shows the end of a double pitch skylight, where the cover element extends beyond the window frames in the ridge length direction and where a vapour barrier has been mounted.

In order to ensure the vapour tightness at the ends of the double pitch skylight, the cover element 3 can be made to extend beyond the window frames in the ridge length direction L as in FIGS. 2 and 5. This will facilitate an interconnection of the cover element 3 to a vapour barrier 5 as shown in FIG. 10, where the vapour barrier 5 is attached to the interior side of the cover element 3 directly below the support member 4. In this embodiment the attachment of the vapour barrier 5 to the cover element 3 has been achieved with a sticky tape (not visible), and the support member 4 serves to keep the cover element in place and prevent substantial deformation of its convex shape when applying the sticky tape. The sticky tape has here been applied only on the interior side of the vapour barrier 5, i.e. on the inside of the double pitch skylight 1, but it will be understood that tape may also or as an alternative be provided on the exterior side.

The adhesive used in the sticky tape can for example be bitumen-based in order to ensure good durability under exposure to water, but other materials are also feasible.

It also possible to provide the vapour barrier 5 with a strip of adhesive (not shown) and/or to interconnect the vapour barrier 5 and the cover element 3 using mechanical means (not shown) as long as a vapour tight connection is achieved.

In this embodiment the vapour barrier 5 has been attached to the frame side members 28 of the two opposite windows 2 by gaskets (not visible) on the edges 51 of the vapour barrier having been inserted in grooves in the frame side members in substantially the same way as the connecting parts 31 of the cover element 3. It is, however, also possible to use sticky tape or a caulking substance.

Figure 11:
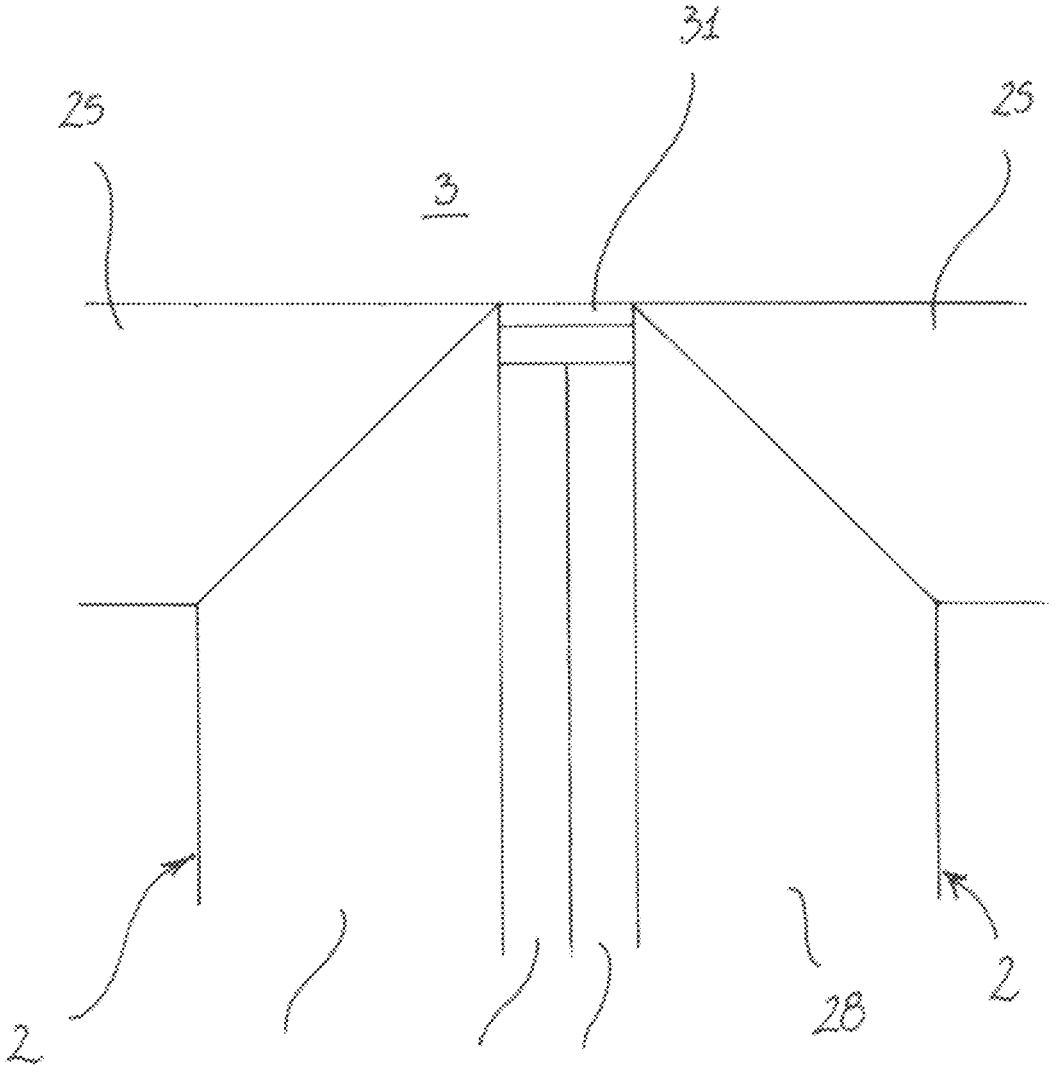
FIG. 11 shows the detail marked XI in FIG. 5.
Figure 12:
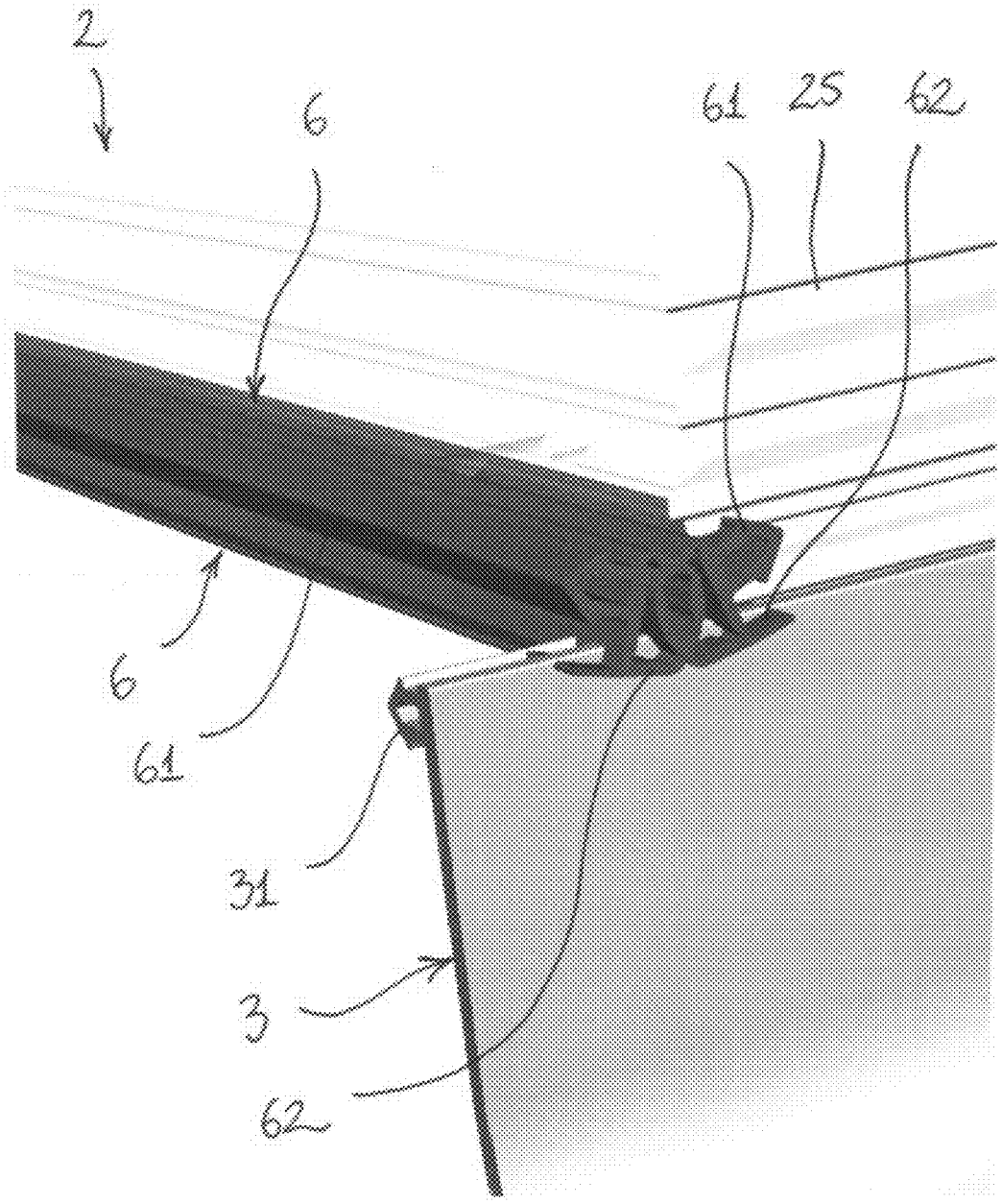
FIG. 12 shows a detail corresponding to the position marked XII in FIG. 4.

FIGS. 11 and 12 show how a vapour-tight connection can be achieved between the cover element 3 and side sealing gaskets 6 provided at the joint between two pairs of windows 2. In FIG. 12 only one window frame 2 is shown in order to make it possible to see the sealing gaskets clearly.

The side sealing gaskets 6 extend along neighbouring frame side members 28 of the windows and are attached thereto by gasket connecting parts 61 being inserted in grooves (not visible) in the same way as described with reference to the cover element connecting parts 31 above. In the mounted state the two sealing gasket 6 are pressed against each other as shown in FIG. 12 so that a vapour tight connection is established between the sides of the window frames.

As is see in FIG. 12 the side sealing gaskets 6 extend beyond the outer surface of the frame top member 25 and over the cover element 3, thus projecting into the space 20 between the top frame members of the windows thereby ensuring an overlap.

The side sealing gaskets 6 and cover element 3 are here shown in their uncompressed state. When mounting the cover element 3, the base parts 62 of the sealing gaskets are pressed upwards during deformation of the centre parts of the sealing gaskets, thereby establishing an overlap and a tight engagement between the cover element 3 and the side sealing gasket(s) 6.

The sealing gaskets are preferably made from an elastic material in order to ensure that material relaxation does not result in a loss of contact between the sealing gaskets 6 and the cover element 3.

The connecting part 31 of the cover member may also be compressed by the contact with the side sealing gaskets 6 at the space between the window frames, where it is not inserted in the grooves in the frame top members 25 of the windows. A compression of both the side sealing gasket 6 and the cover element 3 or parts thereof will result in a particularly good contact between them, especially if both are made from an elastic material.

In this embodiment, the gasket connecting parts 61 are inserted in grooves provided higher on the frame side members 28 than the groove in the top frame member 25 in which the connecting part 31 of the cover element 6 is inserted. This allows the overlap between the sealing gaskets 6 and the connecting part 31 of the cover element 3, which is seen clearly in FIG. 11, showing the finished structure from the interior side. This overlap has the advantage that it is not necessary to interrupt the connecting part 31 of the cover element in order to make room for the side sealing gaskets 6 or vice versa.

In different embodiments, the sealing gaskets 6 are arranged below the cover element 3, so that the connecting parts 31 of the cover element are not visible from the interior side in the mounted state as in FIG. 11. In other embodiments, where the sealing gaskets are of a different design (not shown), one groove extending over both the frame top member and the frame side members may be used for attachment of both the side sealing gaskets and the cover element.

The invention is not limited to the embodiments shown and described in the above, but various modifications and combinations may be carried out.

LIST OF REFERENCE NUMERALS

1 Double pitch skylight
2 Window
20 Space between top frame members
21 First mounting bracket
22 Second mounting bracket
23 Connector element
24 Connector element
25 Frame top member of window
26 Groove in the frame top member
27 Second groove in the frame top member
28 Frame side member of window
3 Cover element
30 Cover part
31 Elastic connecting part
32 Hollow in the connecting part
33 Ridge on connecting part
4 Support member
41 Engagement part of support member
5 Vapour barrier
51 Edge of vapour barrier
6 Side sealing gasket
61 Gasket connecting part
62 Base part of sealing gasket
A Interior ridge angle between interior sides of windows
G Condensation drainage under the influence of gravity
L Ridge length direction

The invention claimed is:

1. A method for covering a gap between windows at a ridge of a double pitch skylight including at least one pair of windows, where each window comprises a frame with a frame top member, an exterior side facing an exterior, an interior side facing an interior of the building, and a set of mounting brackets, said windows of said pair being mounted with their frame top members extending in parallel with each other and in parallel with a ridge length direction, and said windows of said pair being inclined in opposite directions so that an interior ridge angle between their interior sides is less than 180 degrees, said windows of said pair being interconnected by one or more of said mounting brackets at the top frame member of one window being connected to one or more corresponding mounting brackets at the top frame member of the other window, said method including the step of arranging a cover element so that it extends in parallel with the ridge length direction and between the top frame members of the windows of the pair on the interior side, said method further includes the steps of inserting one edge of the cover element in a groove in the top frame member of one window of the pair and inserting another opposite edge of the cover element in a groove in the top frame member of the other window of the pair so that the cover element interconnects the two windows of the pair and wherein the one edge and the another edge of said cover element form a portion of an innermost surface of said cover element.

2. A method according to claim 1, further including the step of bending the cover element about an axis, which is parallel to the ridge length direction, in order to bring the edges into the grooves.

3. A method according to claim 2, where the cover element is provided in a length corresponding substantially to a length of the skylight in the ridge length direction or is cut to length during installation.

4. A method according to claim 2, further including the step of arranging at least one support member on an exterior side of the cover element and connecting the at least one support member to both top frame members.

5. A method according to claim 1, where the cover element is provided in a length corresponding substantially to a length of the skylight in the ridge length direction or is cut to length during installation.

6. A method according to claim 5, further including the step of arranging at least one support member on an exterior side of the cover element and connecting the at least one support member to both top frame members.

7. A method according to claim 1, further including the step of arranging at least one support member on an exterior side of the cover element and connecting the at least one support member to both windows of the pair.

8. A method according to claim 7, further including the steps of covering a gap between windows at the ridge of the double pitch skylight including at least two pairs of windows, providing one or more side sealing gaskets at the joint between the two pairs of windows, said side sealing gasket(s) extending along neighbouring frame side members of the windows of the two pairs, and bringing each edge or connecting part of the cover element into engagement with the side sealing gasket(s).

9. A method according to claim 1, further including the step of connecting at least one end of the cover element to a vapour barrier.

10. A method according to claim 1, further including the steps of covering a gap between windows at the ridge of the double pitch skylight including at least two pairs of windows, providing one or more side sealing gaskets at the joint between the two pairs of windows, said side sealing gasket(s) extending along neighbouring frame side members of the windows of the two pairs, and bringing each edge or connecting part of the cover element into engagement with the side sealing gasket(s) resulting in a compression of the sealing gasket(s) and/or the edges or connecting parts of the cover element.

11. A method of claim 1, further including bending the cover element about an axis which is parallel to the ridge length direction after the step of inserting one edge of the cover element in a groove in the top frame member of one window of the pair and before the step of inserting another opposite edge of the cover element in a groove in the top frame member of the other window of the pair.

12. A method of claim 1, wherein the cover element is formed from a single piece of material.

13. A method of claim 1, wherein each of the one edge and the opposite edge of the cover element include a connecting part that is compressible and the connecting part is retained in a corresponding groove by pressure exerted by the connecting part trying to get back to an original shape of the connecting part prior to compression of the connecting part.

14. A method of claim 13, wherein each connecting part is larger than a corresponding groove and includes a hollow that allows the connecting part to be compressed.

15. A method for covering a gap between windows at a ridge of a double pitch skylight including at least one pair of windows, where each window comprises a frame with a frame top member, an exterior side facing an exterior, an interior side facing an interior of the building, and a set of mounting brackets, said windows of said pair being mounted with their frame top members extending in parallel with each other and in parallel with a ridge length direction, and said windows of said pair being inclined in opposite directions so that an interior ridge angle between their interior sides is less than 180 degrees, said windows of said pair being interconnected by one or more of said mounting brackets at the top frame member of one window being connected to one or more corresponding mounting brackets at the top frame member of the other window, said method including the step of arranging a cover element so that it extends in parallel with the ridge length direction and between the top frame members of the windows of the pair on the interior side, said method further includes the steps of inserting one edge of the cover element in a groove in the top frame member of one window of the pair and inserting another opposite edge of the cover element in a groove in the top frame member of the other window of the pair so that the cover element interconnects the two windows of the pair and where elastic connecting parts on the opposite edges of the cover element are inserted in the grooves during or following a compression of the elastic connecting parts.

16. A method according to claim 15, where the cover element is provided in a length corresponding substantially to a length of the skylight in the ridge length direction or is cut to length during installation.

17. A method according to claim 15, further including the step of arranging at least one support member on an exterior side of the cover element and connecting the at least one support member to both top frame members.

18. A method according to claim 15, further including the step of connecting at least one end of the cover element to a vapour barrier.

19. A method according to claim 15, further including the steps of covering a gap between windows at the ridge of the double pitch skylight including at least two pairs of windows, providing one or more side sealing gaskets at the joint between the two pairs of windows, said side sealing gasket(s) extending along neighbouring frame side members of the windows of the two pairs, and bringing each edge or connecting part of the cover element into engagement with the side sealing gasket(s).

20. A method for covering a gap between windows at a ridge of a double pitch skylight including at least one pair of windows, where each window comprises a frame with a frame top member, an exterior side facing an exterior, an interior side facing an interior of the building, and a set of mounting brackets, said windows of said pair being mounted with their frame top members extending in parallel with each other and in parallel with a ridge length direction, and said windows of said pair being inclined in opposite directions so that an interior ridge angle between their interior sides is less than 180 degrees, said windows of said pair being interconnected by one or more of said mounting brackets at the top frame member of one window being connected to one or more corresponding mounting brackets at the top frame member of the other window, said method including the step of arranging a cover element relative to said pair of windows interconnected by said mounting brackets at the top frame member of one window and the one or more corresponding mounting brackets at the top frame member of the other window so that said cover element extends in parallel with the ridge length direction and between the top frame members on the interior side, subsequent to the step of arranging, connecting the cover element to the pair of windows by the steps of inserting one edge of the cover element in a groove in the top frame member of one window of the pair and inserting another opposite edge of the cover element in a groove in the top frame member of the other window of the pair so that the cover element interconnects the two windows of the pair.

* * * * *